US012035753B2

(12) United States Patent
Wen et al.

(10) Patent No.: US 12,035,753 B2
(45) Date of Patent: Jul. 16, 2024

(54) ATOMIZER AND ELECTRONIC ATOMIZING DEVICE

(71) Applicant: Shenzhen Smoore Technology Limited, Shenzhen (CN)

(72) Inventors: Zhihua Wen, Shenzhen (CN); Boxue Gong, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 342 days.

(21) Appl. No.: 17/507,809

(22) Filed: Oct. 22, 2021

(65) Prior Publication Data

US 2022/0125118 A1 Apr. 28, 2022

(30) Foreign Application Priority Data

Oct. 23, 2020 (CN) ..... 202011148781.0

(51) Int. Cl.
*A24F 40/485* (2020.01)
*A24F 40/10* (2020.01)
*A24F 40/42* (2020.01)

(52) U.S. Cl.
CPC ..... *A24F 40/485* (2020.01); *A24F 40/10* (2020.01); *A24F 40/42* (2020.01)

(58) Field of Classification Search
None
See application file for complete search history.

(56) References Cited

U.S. PATENT DOCUMENTS

2017/0172210 A1* 6/2017 Bright ..... A24F 40/48

FOREIGN PATENT DOCUMENTS

| | | | | | |
|---|---|---|---|---|---|
| CN | 208550022 U | | 3/2019 | | |
| CN | 211020995 U | * | 7/2020 | ..... | A61M 11/042 |
| CN | 211020995 U | | 7/2020 | | |
| CN | 211020996 U | | 7/2020 | | |
| CN | 111616412 A | | 9/2020 | | |
| CN | 111772236 A | * | 10/2020 | ..... | A24F 40/10 |
| CN | 111772236 A | | 10/2020 | | |
| CN | 112189897 A | | 1/2021 | | |
| CN | 214340095 U | | 10/2021 | | |
| WO | WO-2016058139 A1 | * | 4/2016 | ..... | A24F 47/00 |
| WO | WO2020187138 A1 | | 9/2020 | | |

OTHER PUBLICATIONS

International Search Report, International Application No. PCT/CN2021/123611, mailed Nov. 29, 2021(16 pages).
European Search Report, European Application No. 21203915.0, mailed Apr. 7, 2022(9 pages).

* cited by examiner

*Primary Examiner* — Michael H. Wilson
*Assistant Examiner* — Michael T Fulton

(57) ABSTRACT

The present disclosure discloses an atomizer and an electronic atomizing device. The atomizer includes: a reservoir, configured to store liquid; a mounting base, including a housing and a baffle disposed on the housing, the baffle defining a liquid aperture and an air pressure balanced structure spaced apart from the liquid aperture; an atomizing core, disposed within the mounting base, and configured to heat and atomize the liquid. Wherein the air pressure balanced structure communicates the reservoir with outer atmosphere, and is configured to deliver external air into the reservoir, to balance an air pressure of the reservoir and the outer atmosphere.

19 Claims, 7 Drawing Sheets

ATOMIZER AND ELECTRONIC ATOMIZING DEVICE

CROSS REFERENCE

The present application claims the priority of Chinese Patent Application No. 202011148781.0, filed on Oct. 23, 2020, which is entirely incorporated into the present disclosure by reference.

TECHNICAL FIELD

The present disclosure relates to the technical field of atomizing devices, and more particularly to an atomizer and an electronic atomizing device.

BACKGROUND

Electronic atomizing device in the related art is mainly composed of an atomizer and a power supply assembly. The atomizer generally includes a reservoir and an atomizing assembly. The reservoir is configured to store an aerosolizable medium. The atomizing assembly is configured to heat and atomize the aerosolizable medium, to form aerosol which can be taken in by the users. The power supply assembly is configured to provide energy for the atomize.

In the related art, the aerosolizable medium stored in the reservoir is delivered to the atomizing assembly for atomization through a liquid aperture, and external air of outer atmosphere is delivered to the reservoir also through the liquid aperture to replenish an air pressure of the reservoir. Therefore, the external air tends to form bubbles in the liquid aperture in the process of entering the reservoir. In the state where the atomizer atomizes the aerosolizable medium, the bubbles tend to block a narrowest part of a liquid path in the process of entering the reservoir through a liquid aperture, which leads to an insufficient liquid supply to the atomizing assembly, as a result, the aerosolizable medium cannot be replenished to the atomizing assembly, which causing dry heating and overheating of the atomizing assembly, finally the atomizing assembly is damaged due to the insufficient liquid supply, and burnt taste and harmful substances is produced.

SUMMARY

A technical problem addressed by the present disclosure is to provide an atomizer and an electronic atomizing device, to solve the problem of bubbles tending to block the liquid path, which leads to an insufficient liquid supply.

To solve the above technical problem, the first technical solution adopted by the present disclosure is to provide an atomizer. The atomizer comprises: a reservoir, configured to store liquid; a mounting base, including a housing and a baffle disposed on the housing, the baffle defining a liquid aperture and an air pressure balanced structure spaced apart from the liquid aperture; an atomizing core, disposed within the mounting base, and configured to heat and atomize the liquid. Wherein the air pressure balanced structure communicates the reservoir with outer atmosphere, and is configured to deliver external air into the reservoir, to balance an air pressure of the reservoir and the outer atmosphere.

To solve the above technical problem, the second technical solution adopted by the present disclosure is to provide another atomizer. The atomizer includes a shell, an upper seat body and an atomizing core. The shell defines a reservoir. The reservoir is configured to store liquid. The upper seat body is disposed within the shell. The reservoir is disposed on one side of the upper seat body. The atomizing core is disposed on the other side of the upper seat body, and is configured to heat and atomize the liquid. The upper seat body defines a liquid path and an air supply path independent from each other. The liquid path is configured to deliver the liquid within the reservoir to the atomizing core. The air supply path communicates the reservoir with outer atmosphere, and is configured to deliver external air into the reservoir.

To solve the above technical problem, the third technical solution adopted by the present disclosure is to provide an electronic atomizing device. The electronic atomizing device includes an atomizer described above and a power supply assembly. The power supply assembly is configured to power the atomizer.

BRIEF DESCRIPTION OF THE DRAWINGS

In order to illustrate the technical solutions in the embodiments of the present disclosure or the prior art more clearly, the following will briefly introduce the figures needed to be used in the description of the embodiments or the prior art. Obviously, the drawings in the following description are only some embodiments of the present disclosure. Those skilled in the art may derive other figures from these figures without paying any creative work.

DETAILED DESCRIPTION

Figure 1:
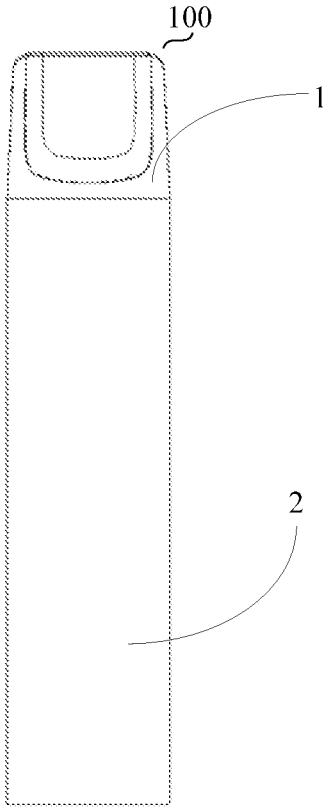
FIG. 1 is a structural schematic figure of an embodiment of an electronic atomizing device provided by the present disclosure.

The technical solutions in the embodiments of the present disclosure will be described clearly and completely with reference to the figures in the embodiments of the present disclosure. Obviously, the described embodiments are only a part of the embodiments of the present disclosure, rather than all the embodiments. Based on the embodiments of the present disclosure, all other embodiments obtained by those skilled in the art without any creative work are within the scope of the present disclosure.

The terms "first", "second", and "third" in the embodiments of the present disclosure are only used for descriptive purposes, and cannot be understood as indicating or implying relative importance or implicitly indicating the number of indicated technical features. Thus, the features defined with "first", "second", and "third" may explicitly or implicitly include at least one of the features. In the description of the present application, "a plurality of" means at least two, e. g., two, three, etc., unless specifically defined otherwise. All directional indications (such as up, down, left, right, front, back) in the embodiments of the present disclosure are only used to account for relative positional relationships, motion conditions, etc., between components in a particular orientation (as shown in the drawings), if the particular orientation changed, correspondingly changes the directional indications. In addition, the terms "including" and "having" and any variations thereof are intended to cover non-exclusive inclusions. For example, a process, method, system, product, or device that includes a series of steps or units is not limited to the listed steps or units, but optionally includes unlisted steps or units, or optionally also includes other steps or units inherent to these processes, methods, products or equipment.

Mentioning "embodiments" herein means that a specific feature, structure, or characteristic described in conjunction with the embodiments may be included in at least one embodiment of the present disclosure. The appearances of the phrase in various places in the specification are not necessarily all referring to the same embodiment, nor are separate or alternative embodiments mutually exclusive of other embodiments. It is explicitly and implicitly understood by those skilled in the art that the embodiments described herein may be combined with other embodiments.

Figure 2:
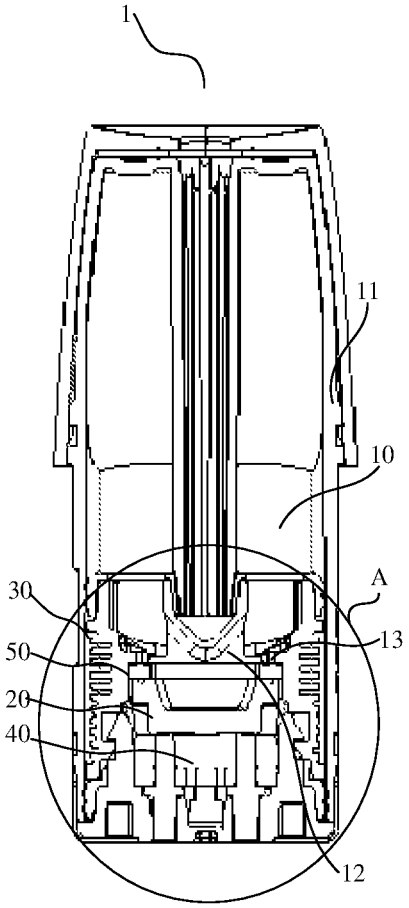
FIG. 2 is a structural schematic figure of an embodiment of an atomizer of the electronic atomizing device provided by the present disclosure.
Figure 3:
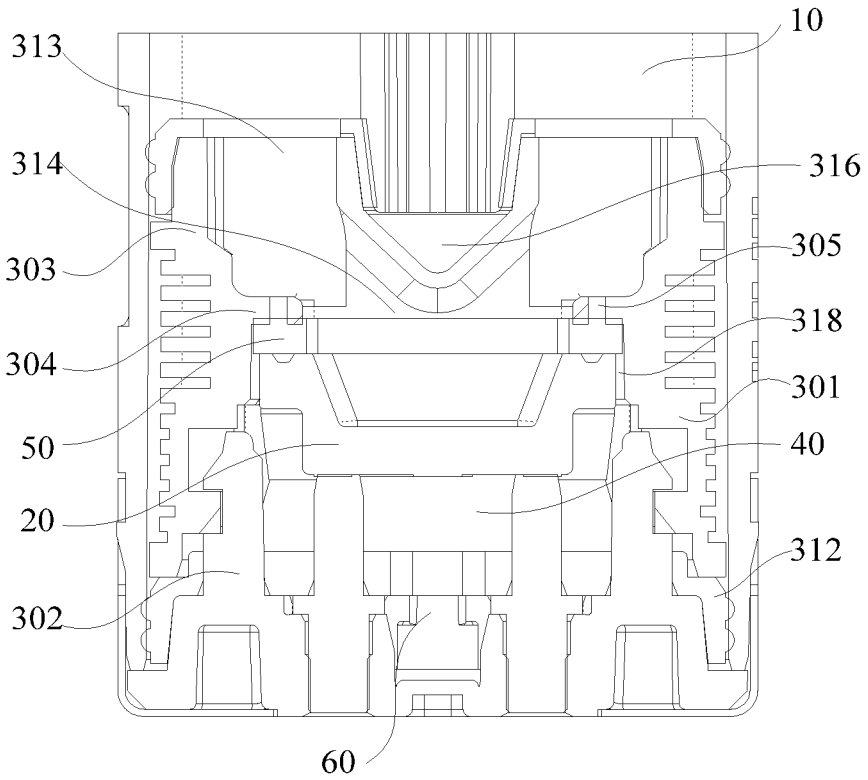
FIG. 3 is a structural schematic figure of part A in FIG. 2 after enlargement.

FIG. 1 is a structural schematic figure of an embodiment of an electronic atomizing device provided by the present disclosure. FIG. 2 is a structural schematic figure of an embodiment of an atomizer of the electronic atomizing device provided by the present disclosure. FIG. 3 is a structural schematic figure of part A in FIG. 2 after enlargement. The electronic atomizing device 100 can be used for the atomization of tobacco oil. The electronic atomizing device 100 provided in the embodiment includes an atomizer 1 and a host 2. The atomizer 1 and the host 2 are detachably connected. The atomizer 1 comprises a reservoir 10, a mounting base 30, and an atomizing core 20. A power supply assembly is provided in the host 2. The atomizer 1 is plugged at one end port of the host 2, and is connected to the power supply assembly within the host 2, such that the atomizing core 20 in the atomizer 1 is powered by the power supply assembly. In the state where the atomizer 1 requires replacement, the atomizer 1 may be disassembled, and a new atomizer 1 is installed on the host 2, enabling reuse of the host 2.

In some embodiments, the electronic atomizing device 100 provided by the present disclosure includes the reservoir 10, the mounting base 30, the atomizing core 20, and a power supply assembly. The reservoir 10, the mounting base 30, the atomizing core 20 and the power assembly are formed of a single piece, and non-detachably connected.

Of course, the electronic atomizing device 100 may further comprises other components of the electronic atomizing device in the prior art, such as, airflow sensor, bracket, and the like, specific structure and function of which are the same as or similar to those of the prior art, and are not described in detail herein.

As shown in FIG. 2, the atomizer 1 generally comprises the reservoir 10, the mounting base 30, the atomizing core 20, and a sealing element 50. The reservoir 10 is configured to store liquid (i.e. tobacco oil). As shown in FIG. 3, the mounting base 30 includes a housing 303 and a baffle 304 disposed on the housing 303. The baffle 304 defines a liquid aperture 314 thereon, the baffle 304 further defines an air pressure balanced structure 305 spaced apart from the liquid aperture 314. The atomizing core 20 is disposed within the mounting base 30, and is configured to heat and atomize the liquid. The air pressure balanced structure 305 communicates the reservoir 10 with outer atmosphere, and is configured to deliver external air into the reservoir 10 to balance an air pressure of the reservoir 10 and the outer atmosphere, such that the liquid can reach the atomizing core 20. The sealing element 50 is provided between the baffle 304 and the atomizing core 20. The sealing element 50 is configured to prevent a liquid leakage of the air pressure balanced structure 305. The sealing element 50 may be a silicone sealing ring.

The mounting base 30 includes an upper seat body 301 and a lower seat body 302, the upper seat body 301 and the lower seat body 302 are fixedly connected. Specifically, the upper seat body 301 and the lower seat body 302 may also be formed of a single piece, or connected by a snap firmware. The lower seat body 302 and the atomizing core 20 together form an atomizing chamber 40. The atomizing core 20 atomizes the tobacco oil and forms smoke in the atomizing chamber 40. The atomizing chamber 40 communicates with a smoke channel 316. The atomizing chamber 40 communicates with the air pressure balanced structure 305. A connection of the upper seat body 301 and the lower seat body 302 is provided with a sealing seat 312. The sealing seat 312 is used to seal the connection of the upper seat body 301 and the lower seat body 302, so as to prevent an occurrence of a liquid leakage.

The lower seat body 302 is provided with an electrode lead, the electrode lead is electrically connected to the heating element of the atomizing core 20, so as to power the atomizing core 20. A side of the lower seat body 302 away from the atomizing core 20 defines an air intake 60. The air intake 60 connects the atomizing chamber 40 and the outer atmosphere. A position of the sealing seat 312 corresponding to the air intake 60 defined on the lower seat body 302 also defines a through-hole, for the external air to enter the atomizing chamber 40. The air input through the air intake 60 may be delivered to the air pressure balanced structure 305 through the atomizing chamber 40, and then input into the reservoir 10, to balance the air pressure of the reservoir 10 and the outer atmosphere.

Specifically, the upper seat body 301 includes the housing 303 described above and the baffle 304 disposed on the housing 303. The baffle 304 defines the liquid aperture 314. The liquid aperture 314 communicates with the reservoir 10, and may allow the liquid within the reservoir 10 to be delivered to the atomizing core 20. In the embodiment, the baffle 304 may divide the space within the housing 303 into a liquid intake chamber 313 and an access chamber 318. The liquid intake chamber 313 and the access chamber 318 communicate with each other through the liquid aperture 314 and the air pressure balanced structure 305 defined on baffle 304. The housing 303 defines the smoke channel 316, the smoke channel 316 and the liquid intake chamber 313 are on the same side. The smoke channel 316 is configured to direct the smoke into oral cavity of user.

In some embodiments, the baffle 304 may be attached to an end of the housing 303 toward the reservoir 10, such that baffle 304 need not to form the liquid intake chamber 313 together with the housing 303. Or the baffle 304 is attached to an end of the housing 303 away from the reservoir 10, such that baffle 304 need not to form the access chamber 318 together with the housing 303. The present disclosure is not intended to limit the specific configuration of the mounting base 30. The following mating relationship of the mounting base 30, the atomizing core 20 and the sealing element 50 is applicable to all kinds of deformed configurations of the mounting base 30. Only if the liquid aperture 314 communicates with the reservoir 10, for example, the reservoir 10 may be a flexible liquid storage pot, a liquid storage sphere, or the like, which is connected to the baffle 304, and the reservoir 10 communicates with liquid aperture 314.

The baffle 304 may be a plate with the liquid aperture 314 defined in the middle and the air pressure balanced structure 305 spaced around the periphery of the liquid aperture 314. In some embodiments, the baffle 304 is a plate with a plurality of liquid apertures 314 in the middle, and the air pressure balanced structure 305 spaced around the periphery of at least one of the liquid aperture 314. The present disclosure does not limit the specific configuration of the baffle 304, only if the liquid aperture 314 defined on the baffle 304 communicates with the reservoir 10, and the air pressure balanced structure 305 defined on the baffle 304 may communicate the reservoir 10 with the outer atmosphere.

Specifically, in the state where the user sucks the electronic atomizing device 100, the atomizing core 20 atomizes the tobacco oil. Along with the user's suction, the external air enters the atomizing chamber 40 through the air intake 60 and carries the smoke within the atomizing chamber 40 to the user's mouth through the smoke channel 316. Meanwhile, the air within the atomizing chamber 40 may be delivered to the reservoir 10 through air pressure balanced structure 305, to balance the air pressure of the reservoir 10, the atomizing chamber 40, and the outer atmosphere, such that the tobacco oil within the reservoir 10 may be smoothly delivered to the atomizing core 20 through the liquid aperture 314, avoiding an occurrence of dry heating of the atomizing core 20.

Figure 4:
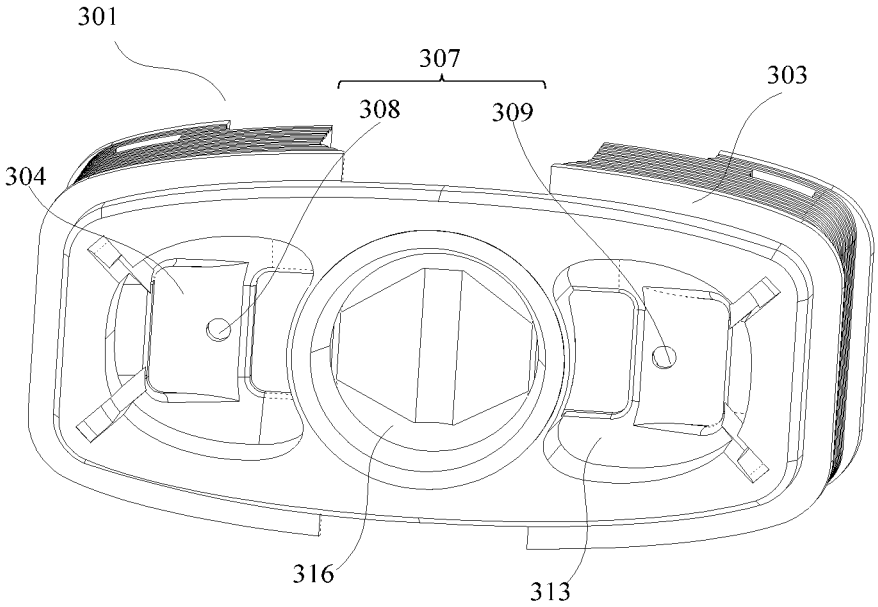
FIG. 4 is a top view of an upper seat body in a mounting base provided by the present disclosure.
Figure 5:
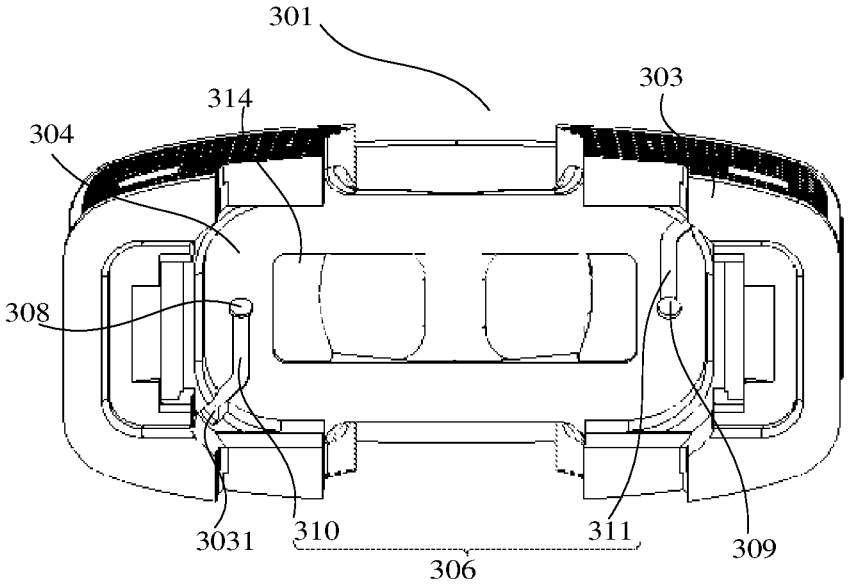
FIG. 5 is a bottom view of a first embodiment of the upper seat body in the mounting base provided by the present disclosure.
Figure 6:
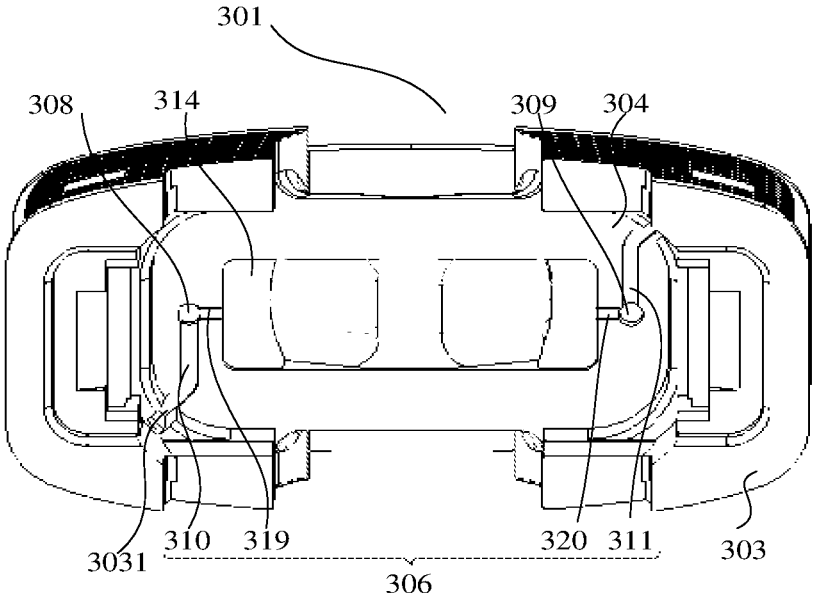
FIG. 6 is a bottom view of a second embodiment of the upper seat body in the mounting base provided by the present disclosure.
Figure 7:
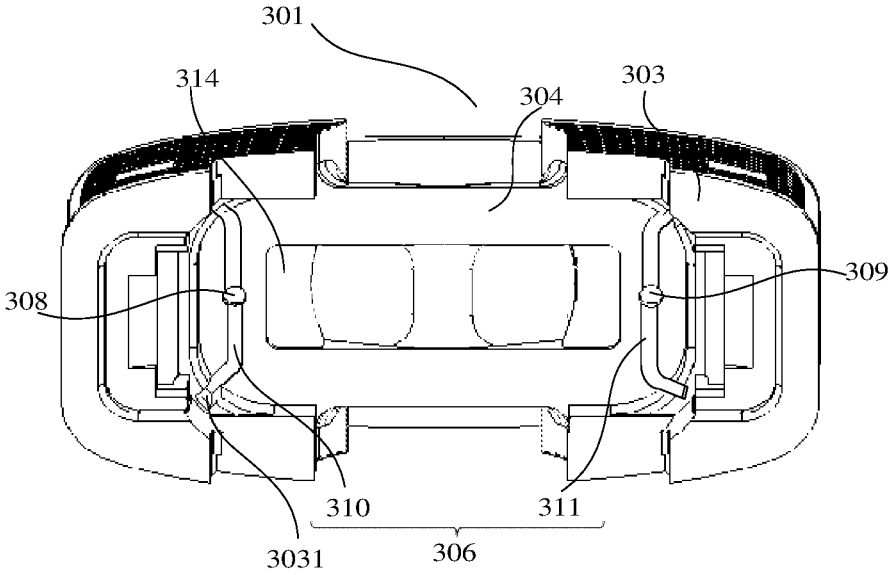
FIG. 7 is a bottom view of a third embodiment of the upper seat body in the mounting base provided by the present disclosure.
Figure 8:
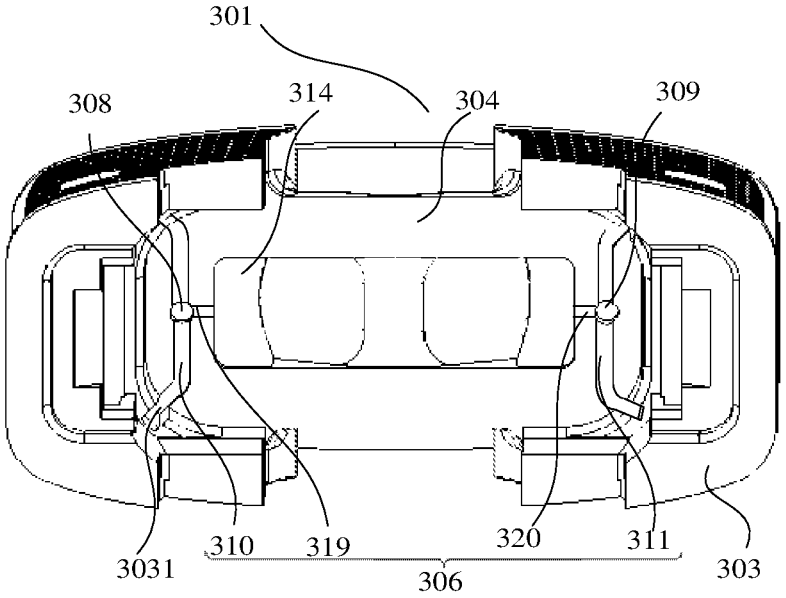
FIG. 8 is a bottom view of a fourth embodiment of the upper seat body in the mounting base provided by the present disclosure.
Figure 9:
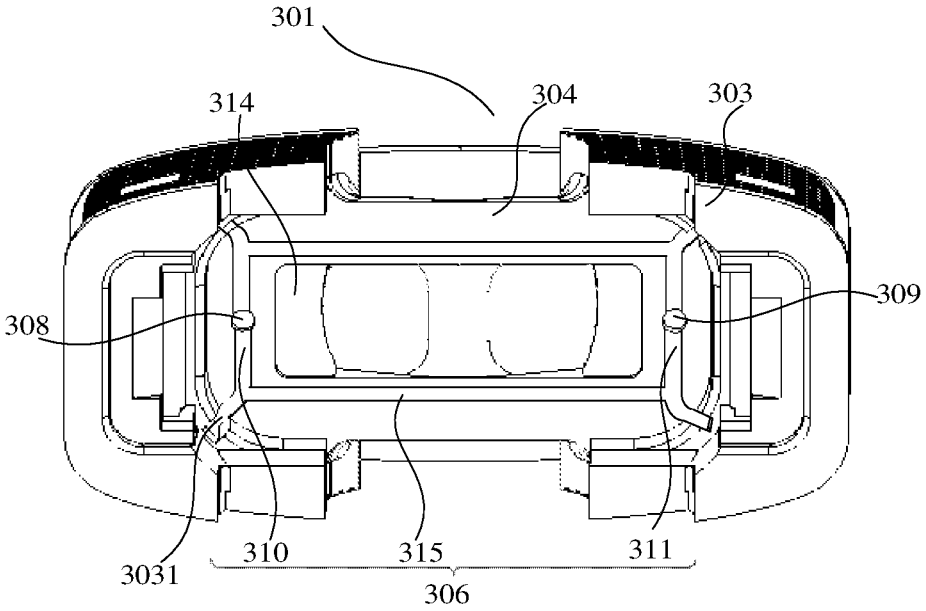
FIG. 9 is a bottom view of the fifth embodiment of the upper seat body in the mounting base provided by the present disclosure.
Figure 10:
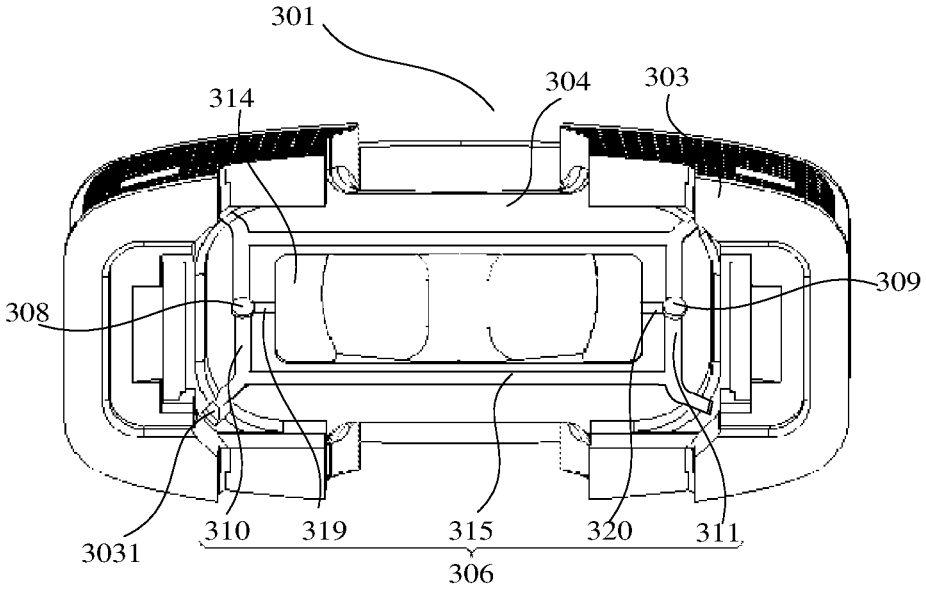
FIG. 10 is a bottom view of the sixth embodiment of the upper seat body of the mounting base provided by the present disclosure.
Figure 11:
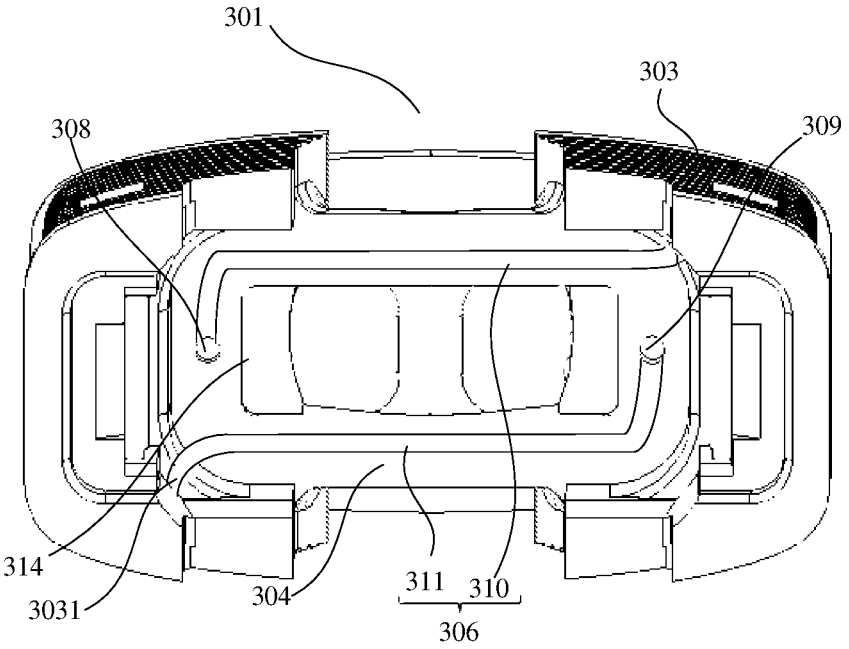
FIG. 11 is a bottom view of a seventh embodiment of the upper seat body in the mounting base provided by the present disclosure.
Figure 12:
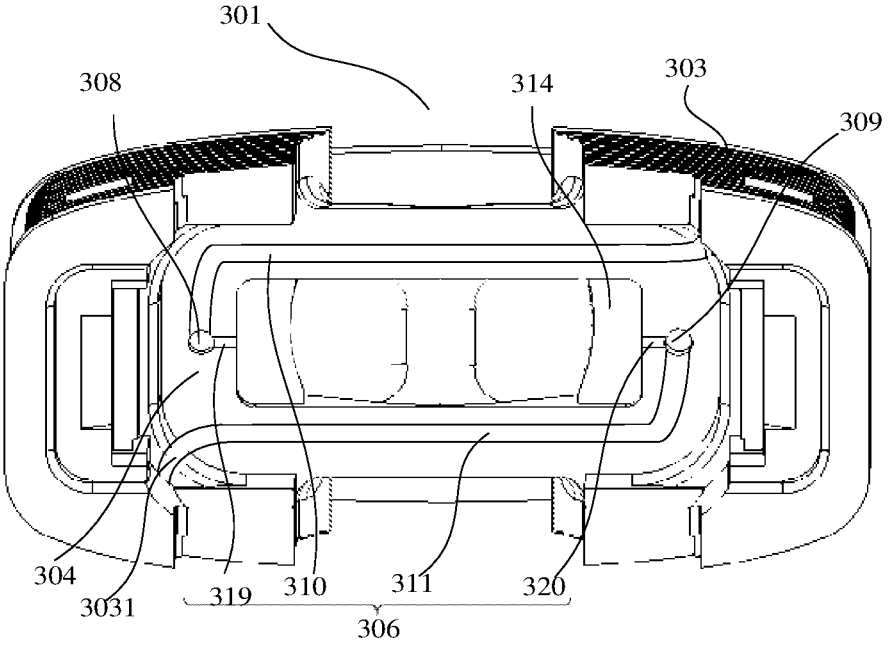
FIG. 12 is a bottom view of an eighth embodiment of the upper seat body in the mounting base provided by the present disclosure.

FIG. 4 is a top view of an upper seat body in a mounting base provided by the present disclosure. FIG. 5 is a bottom view of a first embodiment of the upper seat body in the mounting base provided by the present disclosure. FIG. 6 is a bottom view of a second embodiment of the upper seat body in the mounting base provided by the present disclosure. FIG. 7 is a bottom view of a third embodiment of the upper seat body in the mounting base provided by the present disclosure. FIG. 8 is a bottom view of a fourth embodiment of the upper seat body in the mounting base provided by the present disclosure. FIG. 9 is a bottom view of the fifth embodiment of the upper seat body in the mounting base provided by the present disclosure. FIG. 10 is a bottom view of the sixth embodiment of the upper seat body of the mounting base provided by the present disclosure. FIG. 11 is a bottom view of a seventh embodiment of the upper seat body in the mounting base provided by the present disclosure. FIG. 12 is a bottom view of an eighth embodiment of the upper seat body in the mounting base provided by the present disclosure.

Specifically, the baffle 304 of the upper seat body 301 defines the air pressure balanced structure 305. The air pressure balanced structure 305 includes a gas guiding port structure 307 and a gas guiding groove structure 306. The gas guiding port structure 307 goes through the baffle 304, and is spaced apart from the liquid aperture 314. The gas guiding port structure 307 communicates the liquid intake chamber 313 with the access chamber 318. The gas guiding groove structure 306 is defined on a side of baffle 304 away from the liquid intake chamber 313. One end of the gas guiding groove structure 306 communicates with an end of the gas guiding port structure 307 away from liquid intake chamber 313, the other end of the gas guiding groove structure 306 extends in a direction away from the gas guiding port structure 307, and then communicates with the atomizing chamber 40. An inner surface of the housing 303 defines a connecting slot 3031. The connecting slot 3031 communicates the gas guiding groove structure 306 and the atomizing chamber 40. In some embodiments, the other end of the gas guiding groove structure 306 may also communicates with outer atmosphere directly. A cross section of the gas guiding port structure 307 may be at least one of circular, oval, rectangular, semi-circular, etc., or other shapes which facilitates gas guiding. A number of the gas guiding groove structure 306 communicating with the gas guiding port structure 307 may be one or more, and the number of gas guiding groove structure 306 may be designed according to the actual requirements. The silicone sealing ring is provided between the upper seat body 301 and the atomizing core 20. The silicone sealing ring abuts against the surface of the baffle 304 away from the reservoir 10, such that the gas guiding port structure 307 and the gas guiding groove structure 306 are configured to form a first gas guiding channel between the baffle 304 and the silicone sealing ring. An outer surface of the silicone sealing ring abuts against the inner surface of the housing 303, such that the connecting slot 3031 is configured to form a second gas guiding channel between the housing 303 and the silicone sealing ring, the second gas guiding channel communicates the first gas guiding channel with the atomizing chamber 40. A size of the gas guiding groove structure 306 ranges from 0.1 mm to 0.8 mm, which may be a depth of the gas guiding groove structure 306 or a width of the gas guiding groove structure 306. A size of the cross-section of the gas guiding port structure 307 ranges from 0.1 mm to 1 mm, which may be a length, a width, or a diameter of the cross-section of the gas guiding port structure 307.

In some embodiments, referring to FIGS. 4 and 5, the air pressure balanced structure 305 includes the gas guiding port structure 307 and the gas guiding groove structure 306. The gas guiding port structure 307 is defined on the baffle 304, and is spaced apart from the liquid aperture 314. Specifically, a number of the gas guiding port structure 307 may be one or more. The gas guiding port structure 307 includes a first gas guiding port 308 and a second gas guiding port 309. The gas guiding groove structure 306 includes a first gas guiding groove 310 and a second gas guiding groove 311. The first gas guiding port 308 and the second gas guiding port 309 are arranged symmetrically on both sides of the liquid aperture 314. The first gas guiding groove 310 communicates with an end of the first gas guiding port 308 away from the liquid intake chamber 313. The second gas guiding groove 311 communicates with an end of the second gas guiding port 309 away from the liquid intake chamber 313. The first gas guiding groove 310 extends along an inner wall of the access chamber 318 in a direction away from the first gas guiding port 308. The second gas guiding groove 311 extends along the inner wall of the access chamber 318 in a direction away from the second gas guiding port 309. Therefore, an end of the first gas guiding groove 310 away from the first gas guiding port 308 communicates with the atomizing chamber 40, an end of the second gas guiding groove 311 away from the second gas guiding port 309 communicates with the atomizing chamber 40. The first gas guiding port 308 communicates with the first gas guiding groove 310, the second gas guiding port 309 communicates with the second gas guiding groove 311. The end of the first gas guiding groove 310 away from the first gas guiding port 308 and the end of the second gas guiding groove 311 away from the second gas guiding port 309 extend along the inner wall of the access chamber 318 in a direction away from the baffle 304. The first gas guiding groove 310 and the second gas guiding groove 311 may be arranged symmetrically or asymmetrically. As long as it is convenient for the air in the atomizing chamber 40 to enter the reservoir 10 through the first and second gas guiding grooves 310, 311 and the first and second gas guiding ports 308, 309 connected thereto.

In some embodiments, the end of the first gas guiding groove 310 away from the first gas guiding port 308 and the end of the second gas guiding groove 311 away from the second gas guiding port 309 extend through the housing 303 to communicates with the outer atmosphere directly.

In some embodiments, the end of the first gas guiding groove 310 away from the first gas guiding port 308 communicates with the atomizing chamber 40, and then communicates with the outer atmosphere through the air intake 60 defined in the bottom of the atomizing chamber 40, the end of the second gas guiding groove 311 away from the second gas guiding port 309 extends through the housing 303 and communicates with the outer atmosphere directly.

In some embodiments, referring to FIG. 6, the gas guiding groove structure 306 further includes a third gas guiding groove 319 and a fourth gas guiding groove 320. One end of the third gas guiding groove 319 communicates with the first gas guiding port 308, the other end of the third gas guiding groove 319 communicates with the liquid aperture 314. One end of the fourth gas guiding groove 320 communicates with the second gas guiding port 309, and the other end of the fourth gas guiding groove 320 communicates with the liquid aperture 314. The third gas guiding groove 319 may deliver the air delivered in the first gas guiding groove 310 through the liquid aperture 314. The fourth gas guiding groove 320 may deliver the air delivered in the second gas guiding groove 311 through the liquid aperture 314. Such that the first gas guiding port 308, the second gas guiding port 309, and liquid aperture 314 deliver the air simultaneously, to shorten the time of balancing the air pressure of the reservoir 10 and the outer atmosphere.

In some embodiments, one end of the first gas guiding groove 310 communicates with the atomizing chamber 40 or the outer atmosphere, and the other end of the first gas guiding groove 310 communicates with the first gas guiding port 308. An end of the third gas guiding groove 319 communicates with the atomizing chamber 40 or the outer atmosphere directly, and the other end of the third gas guiding groove 319 communicates with the liquid aperture 314. One end of the second gas guiding groove 311 communicates with the atomizing chamber 40 or the outer atmosphere, and the other end of the second gas guiding groove 311 communicates with the second gas guiding port 309. One end of the fourth gas guiding port 320 communicates with the atomizing chamber 40 or the outer atmosphere directly, and the other end of the fourth gas guiding port 320 communicates with the liquid aperture 314.

In some embodiments, please referring to FIGS. 4 and 7, the air pressure balanced structure 305 includes the gas guiding port structure 307 and the gas guiding groove structure 306 connected to the gas guiding port structure 307. The gas guiding groove structure 306 comprises a first gas guiding groove 310 and a second gas guiding groove 311. The gas guiding port structure 307 comprises a first gas guiding port 308 and a second gas guiding port 309. The first gas guiding port 308 and the second gas guiding port 309 are both disposed on the baffle 304 and spaced apart from the liquid aperture 314. In order to keep the air pressure consistent throughout the reservoir 10, the first gas guiding port 308 and the second gas guiding port 309 are symmetrically disposed on both sides of liquid aperture 314. The first gas guiding groove 310 and the second gas guiding groove 311 are symmetrically disposed on both sides of the liquid aperture 314. The first gas guiding groove 310 and the second gas guiding groove 311 are disposed on the side of the baffle 304 away from the liquid intake chamber 313. The first gas guiding groove 310 communicates with an end of the first gas guiding port 308 away from the liquid intake chamber 313, both two ends of the first gas guiding groove 310 extend along the inner wall of the access chamber 318 in a direction away from the first gas guiding port 308, and then both two ends of the first gas guiding groove 310 communicate with the atomizing chamber 40. The second gas guiding groove 311 communicates with an end of the second gas guiding port 309 away from the liquid intake chamber 313, both two ends of the first gas guiding groove 310 extend along the inner wall of the access chamber 318 in a direction away from the second gas guiding port 309, and then both two ends of the second gas guiding groove 311 communicate with the atomizing chamber 40.

In some embodiments, the end of the first gas guiding groove 310 away from the first gas guiding port 308 and the end of the second gas guiding groove 311 away from the second gas guiding port 309 may extend through the housing 303 to communicate with the outer atmosphere directly.

In some embodiments, at least one of the end of the first gas guiding groove 310 away from the first gas guiding port 308 and the end of the second gas guiding groove 311 away from the second gas guiding port 309 may extend through the housing 303 to communicate with the outer atmosphere directly, and the others communicate with the atomizing chamber 40, and then communicates with the outer atmosphere through the air intake 60 defined in the bottom of the atomizing chamber 40.

In some embodiments, at least one of the end of the first gas guiding groove 310 away from the first gas guiding port 308 and the end of the second gas guiding groove 311 away from the second gas guiding port 309 communicates with the atomizing chamber 40, and then communicates with the outer atmosphere through the air intake 60 defined in the bottom of the atomizing chamber 40, and the others may extend through the housing 303 to communicate with the outer atmosphere directly.

In some embodiments, referring to FIG. 8, the gas guiding groove structure 306 further includes a third gas guiding groove 319 and a fourth gas guiding groove 320. One end of the third gas guiding groove 319 communicates with the first gas guiding port 308, and the other end of the third gas guiding groove 319 communicates with the liquid aperture 314. One end of the fourth gas guiding groove 320 communicates with the second gas guiding port 309, and the other end of the fourth gas guiding groove 320 communicates with the liquid aperture 314. The third gas guiding groove 319 may deliver the air delivered in the first gas guiding groove 310 through the liquid aperture 314. The fourth gas guiding groove 320 may deliver the air delivered in the second gas guiding groove 311 through the liquid aperture 314. Such that the first gas guiding port 308, the second gas guiding port 309, and liquid aperture 314 deliver the air simultaneously, to shorten the time of balancing the air pressure of the reservoir 10 and the outer atmosphere.

In some embodiments, one end of the first gas guiding groove 310 communicates with the atomizing chamber 40 or the outer atmosphere, and the other end of the first gas guiding groove 310 communicates with the first gas guiding port 308. One end of the third gas guiding groove 319 communicates with the atomizing chamber 40 or the outer atmosphere directly, and the other end of the third gas guiding groove 319 communicates with the liquid aperture 314. One end of the second gas guiding groove 311 communicates with the atomizing chamber 40 or the outer atmosphere, and the other end of the second gas guiding groove 311 communicates with the second gas guiding port 309. One end of the fourth gas guiding port 320 communicates with the atomizing chamber 40 or the outer atmosphere directly, and the other end of the fourth gas guiding port 320 communicates with the liquid aperture 314.

In some embodiments, please referring to FIGS. 4 and 9, the air pressure balanced structure 305 includes a gas guiding port structure 307 and a gas guiding groove structure 306 connected to the gas guiding port structure 307. The gas guiding groove structure 306 comprises a first gas guiding groove 310, a second gas guiding groove 311 and a connecting groove 315. The gas guiding port structure 307 comprises a first gas guiding port 308 and a second gas guiding port 309. The first gas guiding port 308 and the second gas guiding port 309 are both disposed on the baffle 304 and spaced apart from the liquid aperture 314. In order to keep the air pressure consistent throughout the reservoir 10, the first gas guiding port 308 and the second gas guiding port 309 are symmetrically disposed on both sides of liquid aperture 314. The first gas guiding groove 310 and the second gas guiding groove 311 are disposed on the side of the baffle 304 away from the liquid intake chamber 313. The first gas guiding groove 310 communicates with an end of the first gas guiding port 308 away from the liquid intake chamber 313, both two ends of the first gas guiding groove 310 extend along the inner wall of the access chamber 318 in a direction away from the first gas guiding port 308, and then both two ends of the first gas guiding groove 310 communicate with the atomizing chamber 40. The second gas guiding groove 311 communicates with an end of the second gas guiding port 309 away from the liquid intake chamber 313, both two ends of the second gas guiding groove 311 extend along the inner wall of the access chamber 318 in a direction away from the second gas guiding port 309, and then both two ends of the second gas guiding groove 311 communicate with the atomizing chamber 40. In order to enhance the stability of air transmission, the second gas guiding groove 311 and the first gas guiding groove 310 are connected by the connecting groove 315. The connecting groove 315 may conduct the air delivered in the first gas guiding groove 310 to the second gas guiding port 309, and may also conduct the air delivered in the second gas guiding groove 311 to the first gas guiding port 308, which is beneficial to balance the air pressure of the reservoir 10 and the outer atmosphere.

In some embodiments, the end of the first gas guiding groove 310 away from the first gas guiding port 308 and the end of the second gas guiding groove 311 away from the second gas guiding port 309 may extend through the housing 303 to communicate with the outer atmosphere directly.

In some embodiments, at least one of the end of the first gas guiding groove 310 away from the first gas guiding port 308 and the end of the second gas guiding groove 311 away from the second gas guiding port 309 may extend through the housing 303 to communicate with the outer atmosphere directly, and the others communicate with the atomizing chamber 40, and then communicates with the outer atmosphere through the air intake 60 defined in the bottom of the atomizing chamber 40.

In some embodiments, at least one of the end of the first gas guiding groove 310 away from the first gas guiding port 308 and the end of the second gas guiding groove 311 away from the second gas guiding port 309 communicates with the atomizing chamber 40, and then communicates with the outer atmosphere through the air intake 60 defined in the bottom of the atomizing chamber 40, and the others may extend through the housing 303 to communicate with the outer atmosphere directly.

In some embodiments, referring to FIG. 10, the gas guiding groove structure 306 further includes a third gas guiding groove 319 and a fourth gas guiding groove 320. One end of the third gas guiding groove 319 communicates with the first gas guiding port 308, and the other end of the third gas guiding groove 319 communicates with the liquid aperture 314. One end of the fourth gas guiding groove 320 communicates with the second gas guiding port 309, and the other end of the fourth gas guiding groove 320 communicates with the liquid aperture 314. The third gas guiding groove 319 may deliver the air delivered in the first gas guiding groove 310 through the liquid aperture 314. The fourth gas guiding groove 320 may deliver the air delivered in the second gas guiding groove 311 through the liquid aperture 314. Such that the first gas guiding port 308, the second gas guiding port 309, and liquid aperture 314 deliver the air simultaneously, to shorten the time of balancing the air pressure of the reservoir 10 and the outer atmosphere.

In some embodiments, one end of the first gas guiding groove 310 communicates with the atomizing chamber 40 or the outer atmosphere, and the other end of the first gas guiding groove 310 communicates with the first gas guiding port 308. One end of the third gas guiding groove 319 communicates with the atomizing chamber 40 or the outer atmosphere directly, and the other end of the third gas guiding groove 319 communicates with the liquid aperture 314. One end of the second gas guiding groove 311 communicates with the atomizing chamber 40 or the outer atmosphere, and the other end of the second gas guiding groove 311 communicates with the second gas guiding port 309. One end of the fourth gas guiding port 320 communicates with the atomizing chamber 40 or the outer atmosphere directly, and the other end of the fourth gas guiding port 320 communicates with the liquid aperture 314.

In some embodiments, referring to FIGS. 4 and 11, the air pressure balanced structure 305 includes a gas guiding port structure 307 and a gas guiding groove structure 306 connected to the gas guiding port structure 307. The gas guiding groove structure 306 comprises a first gas guiding groove 310 and a second gas guiding groove 311. The gas guiding port structure 307 comprises a first gas guiding port 308 and a second gas guiding port 309. The first gas guiding port 308 and the second gas guiding port 309 are both disposed on the baffle 304 and spaced apart from the liquid aperture 314. In order to keep the air pressure consistent throughout the reservoir 10, the first gas guiding port 308 and the second gas guiding port 309 are symmetrically disposed on both sides of liquid aperture 314. The first gas guiding groove 310 and the second gas guiding groove 311 are symmetrically disposed on both sides of the liquid aperture 314. The first gas guiding groove 310 and the second gas guiding groove 311 are disposed on the side of the baffle 304 away from the liquid intake chamber 313. One end of the first gas guiding groove 310 communicates with an end of the first gas guiding port 308 away from the liquid intake chamber 313, the other end of the first gas guiding groove 310 extend along the baffle 304 to a position near the second gas guiding port 309, and then extend along the inner wall of the access chamber 318 to communicate with the atomizing chamber 40. One end of the second gas guiding groove 311 communicates with an end of the second gas guiding port 309 away from the liquid intake chamber 313, the other end of the second gas guiding groove 311 extend along the baffle 304 to a position near the first gas guiding port 308, and then extend along the inner wall of the access chamber 318 to communicate with the atomizing chamber 40, and finally communicates with the outer atmosphere through the air intake 60 in the bottom of the atomizing chamber 40.

In some embodiments, the end of the first gas guiding groove 310 away from the first gas guiding port 308 and the end of the second gas guiding groove 311 away from the second gas guiding port 309 extend through the housing 303 to communicate with the outer atmosphere directly.

In some embodiments, one of the end of the first gas guiding groove 310 away from the first gas guiding port 308 and the end of the second gas guiding groove 311 away from the second gas guiding port 309 may extend through the housing 303 to communicate with the outer atmosphere directly, and the other communicate with the atomizing chamber 40, and then communicates with the outer atmosphere through the air intake 60 defined in the bottom of the atomizing chamber 40.

In some embodiments, referring to FIG. 12, the gas guiding groove structure 306 further includes a third gas guiding groove 319 and a fourth gas guiding groove 320. One end of the third gas guiding groove 319 communicates with the first gas guiding port 308, and the other end of the third gas guiding groove 319 communicates with the liquid aperture 314. One end of the fourth gas guiding groove 320 communicates with the second gas guiding port 309, and the other end of the fourth gas guiding groove 320 communicates with the liquid aperture 314. The third gas guiding groove 319 may deliver the air delivered in the first gas guiding groove 310 through the liquid aperture 314. The fourth gas guiding groove 320 may deliver the air delivered in the second gas guiding groove 311 through the liquid aperture 314. Such that the first gas guiding port 308, the second gas guiding port 309, and liquid aperture 314 deliver the air simultaneously, to shorten the time of balancing the air pressure of the reservoir 10 and the outer atmosphere.

In some embodiments, one end of the first gas guiding groove 310 communicates with the atomizing chamber 40 or the outer atmosphere, and the other end of the first gas guiding groove 310 communicates with the first gas guiding port 308. One end of the third gas guiding groove 319 communicates with the atomizing chamber 40 or the outer atmosphere directly, and the other end of the third gas guiding groove 319 communicates with the liquid aperture 314. One end of the second gas guiding groove 311 communicates with the atomizing chamber 40 or the outer atmosphere, and the other end of the second gas guiding groove 311 communicates with the second gas guiding port 309. One end of the fourth gas guiding port 320 communicates with the atomizing chamber 40 or the outer atmosphere directly, and the other end of the fourth gas guiding port 320 communicates with the liquid aperture 314.

The liquid within the reservoir 10 flows to the atomizing core 20 through the liquid aperture 314. In the state where the air pressure of the reservoir 10 decreases, and a velocity of the liquid within the reservoir 10 flowing to the atomizing core 20 through the liquid aperture 314 is less than a velocity of the atomizing core 20 atomizing the liquid, the air pressure balanced structure 305 delivers the external air into the reservoir 10, such that the air pressure of the reservoir 10 is balanced with the air pressure of the outer atmosphere.

In some embodiments, in the state where the user sucks the electronic atomizing device 100, the atomizing core 20 atomizes the tobacco oil, the air pressure in the atomizing chamber 40 is greater than the air pressure of the reservoir 10, the atomizing chamber 40 communicates with the outer atmosphere, the external air of the outer atmosphere enters the atomizing chamber 40 through the air intake 60, the air in the atomizing chamber 40 is forced to enter the first gas guiding groove 310 and second gas guiding groove 311 due to a pressure difference, the air in the first gas guiding groove 310 enters the reservoir 10 through the first gas guiding port 308, the air in the second gas guiding groove 311 enters the reservoir 10 through the second gas guiding port 309. By transferring air into the reservoir 10 through the first gas guiding port 308 and second gas guiding port 309, the air pressure of the reservoir 10 and the atomizing chamber 40 are balanced, and then the tobacco oil within the reservoir 10 enters the atomizing core 20 through the liquid aperture 314. As a result, the tobacco oil within the reservoir 10 may be smoothly delivered to the atomizing core 20 through the liquid aperture 314, avoiding an occurrence of dry heating of the atomizing core 20.

In some embodiments, in the state where the user sucks the electronic atomizing device 100, the atomizing core 20 atomizes the tobacco oil, the air pressure in the atomizing chamber 40 is greater than the air pressure of the reservoir 10, the external air of outer atmosphere is forced to enter the first gas guiding groove 310 and second gas guiding groove 311 due to a pressure difference, the air in the first gas guiding groove 310 enters the reservoir 10 through the first gas guiding port 308, the air in the second gas guiding groove 311 enters the reservoir 10 through the second gas guiding port 309. By transferring air into the reservoir 10 through the first gas guiding port 308 and second gas guiding port 309, the air pressure of the reservoir 10 and the atomizing chamber 40 are balanced, and then the tobacco oil within the reservoir 10 enters the atomizing core 20 through the liquid aperture 314. As a result, the tobacco oil within the reservoir 10 may be smoothly delivered to the atomizing core 20 through the liquid aperture 314, avoiding an occurrence of dry heating of the atomizing core 20.

In some embodiments, in the state where the user sucks the electronic atomizing device 100, the atomizing core 20 atomizes the tobacco oil, the air pressure in the atomizing chamber 40 is greater than the air pressure of the reservoir 10, the atomizing chamber 40 communicates with the outer atmosphere, the external air of outer atmosphere enters the atomizing chamber 40 through the air intake 60, the air in the atomizing chamber 40 is forced to enter the first gas guiding groove 310 and second gas guiding groove 311 due to a pressure difference, the air in the first gas guiding groove 310 enters the reservoir 10 through the first gas guiding port 308. In the state where an amount of the air delivered by the first gas guiding groove 310 is greater than an amount of air delivered by the first gas guiding port 308, the third gas guiding groove 319 deliver the air which has not been delivered in the first gas groove 310 to the reservoir 10 through liquid aperture 314. In the state where an amount of the air delivered by the second gas guiding groove 311 is greater than an amount of air delivered by the second gas guiding port 309, the fourth gas guiding groove 320 deliver the air which has not been delivered in the second gas groove 311 to the reservoir 10 through liquid aperture 314. By transferring air into the reservoir 10 through the first gas guiding port 308, the second gas guiding port 309 and the liquid aperture 314, the air pressure of the reservoir 10 and the atomizing chamber 40 are balanced, and then the tobacco oil within the reservoir 10 enters the atomizing core 20 through the liquid aperture 314. As a result, the tobacco oil within the reservoir 10 may be smoothly delivered to the atomizing core 20 through the liquid aperture 314, avoiding an occurrence of dry heating of the atomizing core 20.

The embodiment provides an atomizer and an electronic atomizing device. The atomizer includes: a reservoir, configured to store liquid; a mounting base, including a housing and a baffle disposed on the housing, the baffle defining a liquid aperture and an air pressure balanced structure spaced apart from the liquid aperture; an atomizing core, disposed within the mounting base, and configured to heat and atomize the liquid. The air pressure balanced structure communicates the reservoir with outer atmosphere, and is configured to deliver external air into the reservoir, to balance an air pressure of the reservoir and the outer atmosphere. By defining the air pressure balanced structure spaced apart from the liquid aperture on the baffle, a liquid path and an air supply path are independent from each other in the present disclosure, so as to avoid an occurrence of bubbles blocking the liquid path in the liquid aperture. By defining the air pressure balanced structure, a balance between the reservoir and the outer atmosphere may be achieved, and the problem that an insufficient liquid supply leads to a dry heating of the atomizing core is addressed. The structure is simple and easy to achieve.

The embodiment provides an atomizer 1. The atomizer includes a shell 11, an upper seat body 301 and an atomizing core 20. The shell 11 defines a reservoir 10. The reservoir 10 is configured to store liquid. The upper seat body 301 is disposed within the shell 11. The reservoir 10 is disposed on one side of the upper seat body 301. The atomizing core 20 is disposed on the other side of the upper seat body 301, and is configured to heat and atomize the liquid. The upper seat body 301 defines a liquid path 12 and an air supply path 13 independent from each other. The liquid path 12 is configured to deliver the liquid within the reservoir 10 to the atomizing core 20. The air supply path 13 communicates the reservoir 10 with outer atmosphere, and is configured to deliver external air into the reservoir 10.

The above description are only embodiments of the present disclosure, and do not limit the scope of the present disclosure. Any equivalent structure or equivalent process transformation made by using the contents of the description and drawings of the present disclosure, or directly or indirectly used in other related technical fields, are similarly included in the scope of patent protection of the present disclosure.

What is claimed is:

1. An atomizer, comprising:

a reservoir, configured to store liquid;

a mounting base, comprising a housing and a baffle disposed on the housing, the baffle defining a liquid aperture and an air pressure balanced structure spaced apart from the liquid aperture;

an atomizing core, disposed within the mounting base, and configured to heat and atomize the liquid;

wherein the air pressure balanced structure communicates the reservoir with outer atmosphere, and is configured to deliver external air into the reservoir, to balance an air pressure of the reservoir and the outer atmosphere; and wherein the air pressure balanced structure is independent from the liquid aperture.

2. The atomizer of claim 1, wherein the liquid within the reservoir flows to the atomizing core through the liquid aperture; in the state where the air pressure of the reservoir decreases, and a velocity of the liquid within the reservoir flowing to the atomizing core through the liquid aperture is less than a velocity of the atomizing core atomizing the liquid, the outer atmosphere delivers the external air into the reservoir through the air pressure balanced structure, such that the air pressure of the reservoir is balanced with the air pressure of the outer atmosphere.

3. The atomizer of claim 2, wherein the air pressure balanced structure comprises a gas guiding port structure and a gas guiding groove structure communicating with the gas guiding port structure; the gas guiding port structure is extended through the baffle, is spaced apart from the liquid aperture, and communicates with the reservoir; the gas guiding groove structure is defined on a surface of the baffle away from the reservoir, the gas guiding groove structure communicates the outer atmosphere with the gas guiding port structure.

4. The atomizer of claim 3, wherein the atomizing core and the mounting base together form an atomizing chamber; one end of the gas guiding groove structure communicates with the gas guiding port structure, the other end of the gas guiding groove structure extends in a direction away from the gas guiding port structure, and communicates with the outer atmosphere through the atomizing chamber.

5. The atomizer of claim 3, wherein one end of the gas guiding groove structure communicates with the gas guiding port structure, the other end of the gas guiding groove structure extends in a direction away from the gas guiding port structure and communicates with the outer atmosphere directly.

6. The atomizer of claim 3, wherein the atomizing core and the mounting base together form an atomizing chamber; wherein the gas guiding groove structure communicates with the gas guiding port structure, both two ends of the gas guiding groove structure extend in a direction away from the gas guiding port structure, and communicate with the outer atmosphere through the atomizing chamber.

7. The atomizer of claim 3, wherein the gas guiding groove structure communicates with the gas guiding port structure, both two ends of the gas guiding groove structure extend in a direction away from the gas guiding port structure, and communicate with the outer atmosphere directly.

8. The atomizer of claim 3, wherein the gas guiding groove structure comprises a first gas guiding groove and a second gas guiding groove; the gas guiding port structure comprises a first gas guiding port and a second gas guiding port; the first gas guiding port is defined on one side of the liquid aperture, the second gas guiding port is defined on the other side of the liquid aperture; one end of the first gas guiding groove communicates with the first gas guiding port, the other end of the first gas guiding groove extends to a position near the second gas guiding port and then communicates with the atomizing chamber; one end of the second gas guiding groove communicates with the second gas guiding port, the other end of the second gas guiding groove extends to a position near the first gas guiding port and then communicates with the atomizing chamber.

9. The atomizer of claim 3, wherein an end of the gas guiding groove structure communicating with the gas guiding port structure extends to the liquid aperture, the gas guiding groove structure connects the outer atmosphere, the gas guiding port structure, and the liquid aperture.

10. The atomizer of claim 3, wherein a sealing element is provided between the baffle and the atomizing core, the sealing element is configured to prevent a liquid leakage of the air pressure balanced structure.

11. The atomizer of claim 4, wherein the gas guiding groove structure comprises a first gas guiding groove and a second gas guiding groove, the gas guiding port structure comprises a first gas guiding port and a second gas guiding port; the first gas guiding port is defined on one side of the liquid aperture, the second gas guiding port is defined on the other side of the liquid aperture; one end of the first gas guiding groove communicates with the first gas guiding port, the other end of the first gas guiding groove extends in a direction away from the first gas guiding port, and then communicates with the atomizing chamber; one end of the second gas guiding groove communicates with the second gas guiding port, the other end of the second gas guiding groove extends in a direction away from the second gas guiding port, and then communicates with the atomizing chamber.

12. The atomizer of claim 11, wherein the gas guiding groove structure further comprises a third gas guiding groove and a fourth gas guiding groove, the third gas guiding groove communicates the first gas guiding port with the liquid aperture, the fourth gas guiding groove communicates the second gas guiding port with the liquid aperture.

13. The atomizer of claim 4, wherein an inner surface of the housing defines a connecting slot, the connecting slot communicates the gas guiding groove structure and the atomizing chamber.

14. The atomizer of claim 6, wherein the gas guiding groove structure comprises a first gas guiding groove and a second gas guiding groove; the gas guiding port structure comprises a first gas guiding port and a second gas guiding port; the first gas guiding port is defined on one side of the liquid aperture, the second gas guiding port is defined on the other side of the liquid aperture; the first gas guiding port communicates with the first gas guiding groove, the second gas guiding port communicates with the second gas guiding groove; both two ends of the first gas guiding groove extend in a direction away from the first gas guiding port, and then communicate with the atomizing chamber; both two ends of the second gas guiding groove extend in a direction away from the second gas guiding port, and then communicate with the atomizing chamber.

15. The atomizer of claim 14, wherein the gas guiding groove structure further comprises a third gas guiding groove and a fourth gas guiding groove, the third gas guiding groove communicates the first gas guiding port with the liquid aperture, the fourth gas guiding groove communicates the second gas guiding port with the liquid aperture.

16. The atomizer of claim 14, wherein the gas guiding groove structure further comprises a connecting groove, the connecting groove communicates the first gas guiding groove with the second gas guiding groove.

17. The atomizer of claim 10, wherein the sealing element is a silicone sealing ring, the silicone sealing ring abuts against the surface of the baffle away from the reservoir, the gas guiding port structure and the gas guiding groove structure are configured to form a first gas guiding channel between the baffle and the silicone sealing ring.

18. The atomizer of claim 17, wherein the atomizing core and the mounting base together form an atomizing chamber, the gas guiding groove structure communicates with the outer atmosphere through the atomizing chamber; an inner surface of the housing defines a connecting slot, the connecting slot communicates the gas guiding groove structure and the atomizing chamber; an outer surface of the silicone sealing ring abuts against the inner surface of the housing, the connecting slot is configured to form a second gas guiding channel between the housing and the silicone sealing ring, the second gas guiding channel communicates the first gas guiding channel with the atomizing chamber.

19. An electronic atomizing device, comprising a host and an atomizer, the host being configured to power the atomizer, the atomizer comprising:

a reservoir, configured to store liquid;

a mounting base, comprising a housing and a baffle disposed on the housing, the baffle defining a liquid aperture and an air pressure balanced structure spaced apart from the liquid aperture;

an atomizing core, disposed within the mounting base, and configured to heat and atomize the liquid;

wherein the air pressure balanced structure communicates the reservoir with outer atmosphere, and is configured to deliver external air into the reservoir, to balance an air pressure of the reservoir and the outer atmosphere; and wherein the air pressure balanced structure is independent from the liquid aperture.

* * * * *